US006941988B2

(12) United States Patent
Peetso et al.

(10) Patent No.: US 6,941,988 B2
(45) Date of Patent: Sep. 13, 2005

(54) BATCH ROTARY DEBARKER

(75) Inventors: Victor Peetso, Kelowna (CA); Alister Hume, Surrey (CA)

(73) Assignee: RealSearch Inc., Kelowna (CA)

( * ) Notice: Subject to any disclaimer, the term of this patent is extended or adjusted under 35 U.S.C. 154(b) by 3 days.

(21) Appl. No.: 10/248,857

(22) Filed: Feb. 25, 2003

(65) Prior Publication Data

US 2003/0159760 A1 Aug. 28, 2003

Related U.S. Application Data

(60) Provisional application No. 60/319,122, filed on Feb. 25, 2002.

(51) Int. Cl.[7] ..... B27L 1/05
(52) U.S. Cl. ..... 144/341; 144/208.9
(58) Field of Search ..... 144/340, 208.1, 144/208.4, 208.5, 208.7, 208.8, 208.9, 341 OR; 241/285.3, 236; 83/147, 163, 165, 166

(56) References Cited

U.S. PATENT DOCUMENTS 1,281,155 A * 10/1918 Guettler ..... 144/208.9
2,137,452 A * 11/1938 Hillbom ..... 144/208.9
2,506,919 A * 5/1950 Frank ..... 83/147
4,385,732 A * 5/1983 Williams ..... 241/285.3
4,691,750 A * 9/1987 Nakajima ..... 144/208.9
5,394,912 A 3/1995 Hume
5,562,257 A * 10/1996 Graveman et al. ..... 241/236
5,630,453 A * 5/1997 Ishizawa ..... 144/208.9
5,673,865 A * 10/1997 Stroulger ..... 241/236
6,615,884 B2 * 9/2003 Havumaki et al. ..... 144/208.9

FOREIGN PATENT DOCUMENTS

SE 158984 5/1957

OTHER PUBLICATIONS

Progress Industries Inc., Catalogue, "Drum Debarker".

* cited by examiner

*Primary Examiner*—Derris H. Banks
*Assistant Examiner*—Shelley Self
(74) *Attorney, Agent, or Firm*—Bennett Jones LLP

(57) ABSTRACT

A batch debarking apparatus includes a rectangular bin and a plurality of abrader rotors placed across the bin. Log batches are debarked within the bin and discharged laterally through one sidewall of the apparatus.

13 Claims, 14 Drawing Sheets

1/2" I.F.O.

2 1/2" I.F.O.

4 1/2" I.F.O.

5 ROTOR MACHINE

4 ROTOR MACHINE

3 ROTOR MACHINE

3 ROTOR MACHINE

BATCH ROTARY DEBARKER

CROSS REFERENCE TO RELATED APPLICATIONS

This application claims the priority benefit of U.S. Provisional Application No. 60/319,122 filed on Feb. 25, 2002.

BACKGROUND OF INVENTION

The present invention relates to an apparatus and method for debarking logs prior to further processing such as lumber production or production of wood chips.

Log debarking is typically accomplished using ring debarkers or drum debarkers. In a ring debarker, a log passes through a ring of abrasive or cutting heads which contact the circumference of the log. By necessity, a ring debarker may only handle one log at a time and therefore multiple units operating at high speeds are required for efficient processing of small diameter stems. As well, ring debarkers are subject to high stresses from the impact of logs propelled at high speed from the log delivery system.

A drum debarker has a continuously rotating drum which is partially filled with logs (usually from 30 to 40% full by volume) and as the drum rotates, the log burden inside the drum is lifted causing the logs to cascade down and roll back on and impact the logs below. It is this continuously lifting, rotational and impacting/rubbing action of logs on each other that removes the bark as the logs progress down the drum toward the discharge gate. The logs are usually fed into the drum in a continuous stream of groups of logs from an elevated hopper at one end of the drum and slide by gravity into the drum. Although drum debarkers can process large volumes of logs, pretreatment is usually required to achieve acceptable debarking cleanliness when dealing with severe winter conditions (frozen logs) or difficult to debark species.

Rotary debarkers exist which use rollers having debarking teeth or bars. An example of a rotary debarker is the Fuji King debarker designed by Fuji Kogyo and licensed to CAE in Canada. In this example, the debarker consists of a fixed trough assembly containing a pair of openings to allow the placement of a cylindrical rotor in each opening. The rotors are mounted at their ends on roller bearings and are driven with electrical drives. Mounted on the surfaces of the rotors are debarking plates. The rotors are very tight within their openings and the protruding plates pass through slits in the edges of these openings. Logs and branches typically are fed into the debarker with a transverse chain deck. The deck feeds an infeed hopper that delivers the logs into the trough in the same axis as the rotors. As the furnish enters the debarker, it is impacted by the plates on the surface of the spinning rotors. The contact of these plates begins the removal of bark by first breaking the bond with the fiber at the cambium layer. Additionally, the plates cause the logs to spin about their own axis and move within the trough, contacting the other logs and branches. Bark is abraded from the logs through mutual contact and the striking of the plates.

The wood fibre debris processor disclosed in co-owned U.S. Pat. No. 5,394,912 (the contents of which are hereby incorporated in its entirety) may also be used as an effective debarker machine. Like the Fuji King debarker, the logs are fed into one end of the apparatus and discharged at the other end, traveling in a direction consistent with their longitudinal axis.

However, there is a need in the art for rotary type debarker which mitigates the disadvantages of the prior art and which improves upon or provides an effective alternative to the prior art.

SUMMARY OF INVENTION

The present invention is directed to a rotary debarker and wood fibre processor which may batch process logs and discharge the debarked logs laterally. In its most basic form, the debarker is adapted to accept batches or bundles of logs and to discharge them laterally instead of longitudinally.

Accordingly, in one aspect of the invention, the invention comprises a debarking apparatus comprising:

(a) a rectangular bin having two endwalls and two elongate sidewalls;

(b) a plurality of substantially parallel abrader rotors placed across the bin;

(c) a plurality of abrader blocks attached to the abrader rotors in a longitudinally spaced manner; and (d) wherein one sidewall or a portion of one sidewall may be displaced to release logs held within the bin.

In one embodiment, the debarker may have a live floor comprising the rotors and abraders and an open bottom where the bark and small debris may accumulate. Alternatively, elongated finger plates may be provided between adjacent rotors. Preferably, there are three or more rotors which are arrayed on an incline such that the rotors are parallel but not on the same horizontal plane. The rotors may be independently rotated to rotate in the same or different directions and at the same or different speeds. The abrader blocks may be fitted with replaceable abrader tips, which may be welded or bolted to the blocks. Various designs of abrader blocks and tips are possible, besides those disclosed herein. The abrader blocks and tips may be aligned parallel to the longitudinal axis of the rotors or may be offset. In one embodiment, the abrader tips may be aligned helically about the rotors.

In one embodiment, the sidewall may be raised or lowered vertically to release logs. Alternatively, the sidewall may be hinged, either at the top or bottom, to swing outwards. In one embodiment, the sidewall may move vertically and also be hinged.

A control system is preferably provided to allow remote or electronic control of the debarking process, including dwell time, speed and direction of shaft rotation and other variable parameters of the process. The control system may include a programmable logic controller ("PLC").

The debarker may accept logs simply using a grapple loader or a hopper which aligns the logs and directs them into the debarker. Alternatively, a live hood may be incorporated to ensure or assist in log orientation and rotation.

In another aspect of the invention, the invention comprises method of debarking logs comprising the steps of:

(a) providing a debarking apparatus including a rectangular bin having two endwalls and two elongate sidewalls; a plurality of abrader rotors placed across a lower section of the bin parallel with the sidewalls; a plurality of abrader blocks attached to the abrader rotors, and one sidewall or a portion of one sidewall may be displaced to release logs held within the bin;

(b) introducing a batch of logs into the apparatus and rotating the rotors until the logs are substantially debarked;

(c) displacing the sidewall to discharge the logs laterally.

The logs may be discharged laterally into a receiving chamber, a conveyor, a step feeder, a quandrant feeder or other transfer mechanism, or a singulation device. The debarker may be portable or rail mounted and used to transport logs within a facility to various discharge points.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

The present invention provides for a method and apparatus for debarking logs. When describing the present invention, all terms not defined herein have their common art-recognized meanings.

Figure 1:
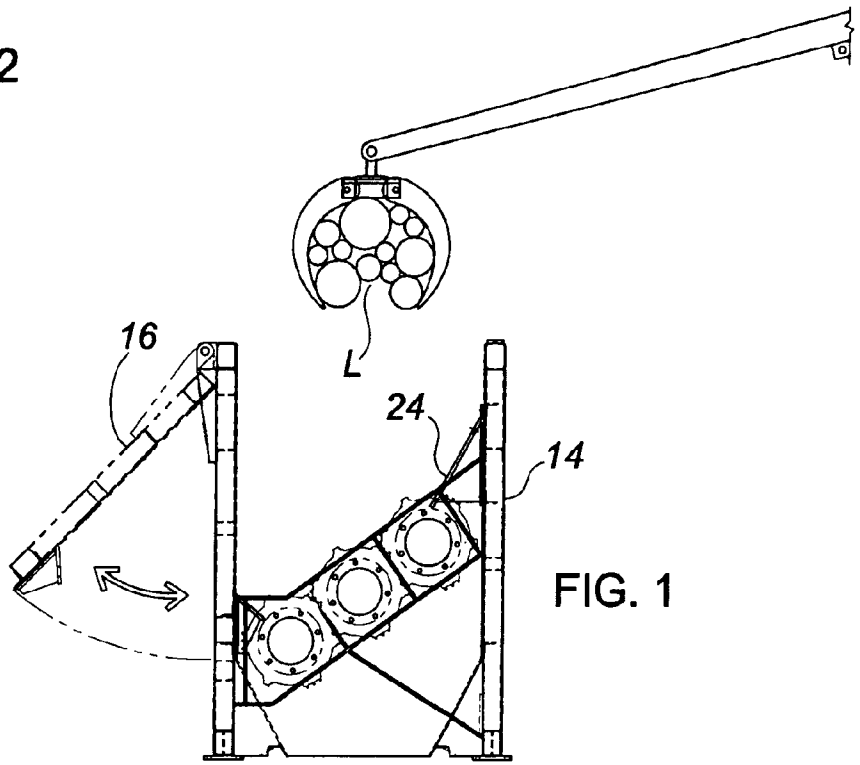
FIG. 1 is a vertical cross-section view of one embodiment.
Figure 2:
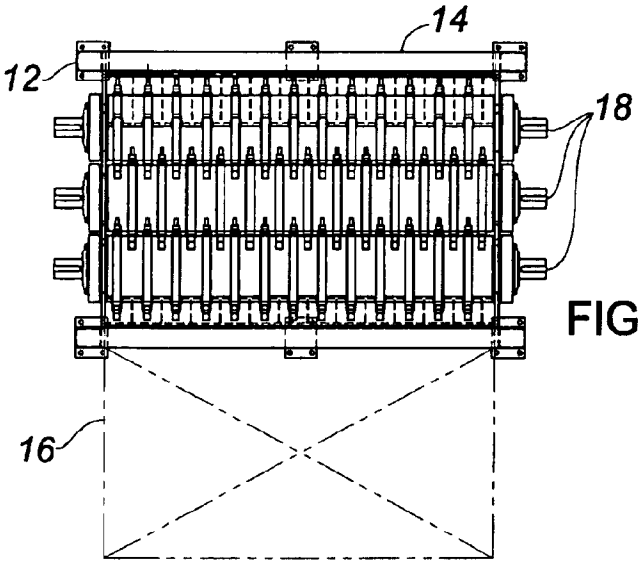
FIG. 2 is a top plan view of one embodiment.
Figure 3:
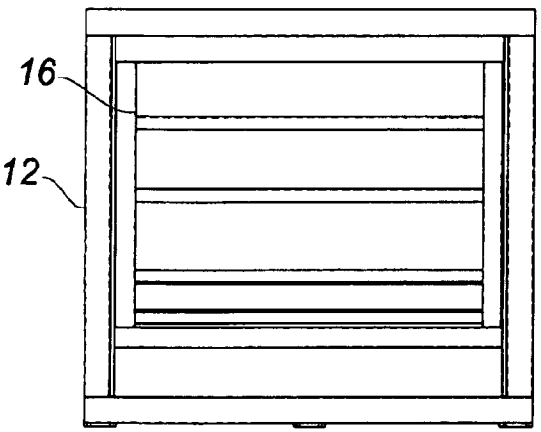
FIG. 3 is a front elevation view of one embodiment.

As shown in FIGS. 1, 2 and 3, the apparatus comprises a bin (10) constructed of structural steel which has two end walls (12) and a closed sidewall (14) and a discharge sidewall (16). The bin may therefore have a rectangular horizontal and vertical cross-section. Three rotating rotors (18) are disposed within the bin along a substantially horizontal plane. In a preferred embodiment, the plane of the three rotors (18) is inclined downwardly towards the discharge sidewall (16) and each rotor (18) is parallel to each other. It is conceivable that non-parallel rotors may be used.

Logs (L) may be top-loaded into the bin by means of a grapple loader is shown in FIG. 1. However, the means and orientation of loading the logs is not an essential part of the invention. Any means of placing a batch of logs within the debarker is intended to be within the scope of the present invention. In one embodiment, the closed sidewall (14) may open to permit entry of a batch of logs.

The discharge sidewall (16) is hinged along its top edge permitting its bottom edge to swing outwards as illustrated. When the discharge sidewall is opened in that fashion, it is readily seen that logs may be laterally discharged from the bin.

While size is not a limiting factor of the present invention, bins may generally be 3 to 9 meters long, 3 to 5 meters wide and 3 to 9 meters high. The bins and rotors may be made longer to allow for debarking of longer logs, as necessary. The bins may be made larger to process larger quantities of logs if desired.

The rotors (18) each carry a plurality of abrader assemblies (20) which are spaced along the longitudinal length of each rotor (18). The abrader assemblies (20) comprise ring-like projections around the circumference of the rotor and are preferably staggered on adjacent rotors in an alternating interleaved fashion. This arrangement of rotors and abrader assemblies (20) creates a live floor with gaps. The size of the gaps are governed by the lateral spacing between adjacent rotors as well as the longitudinal spacing of the abrader assemblies along the rotors. As seen in FIG. 3, the bottom portion of the bin is open to receive bark which is removed from the logs and which falls through the gaps.

Also seen in FIG. 1 are the top fingerplate (24) and the bottom fingerplate (22) which are affixed to the closed sidewall (14) and discharge sidewall (16) respectively.

Figure 4:
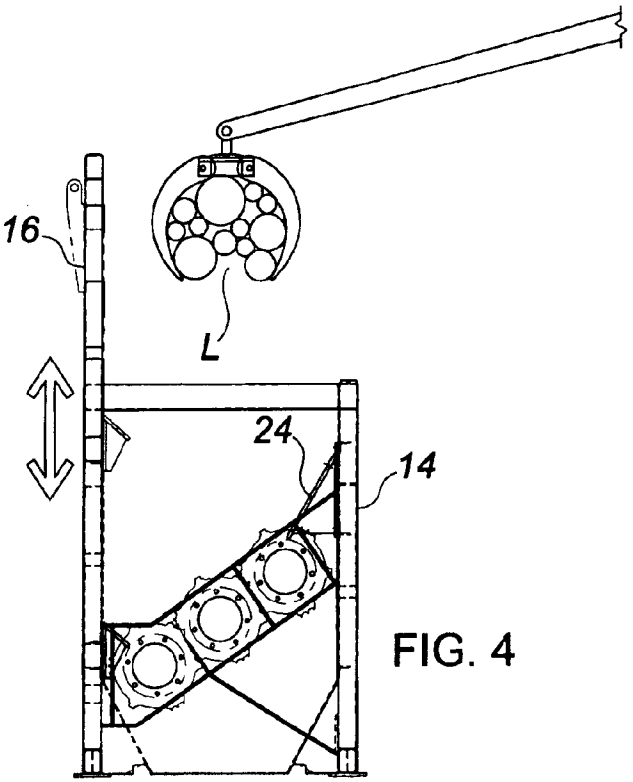
FIG. 4 is a vertical cross-section view of one embodiment.
Figure 5:
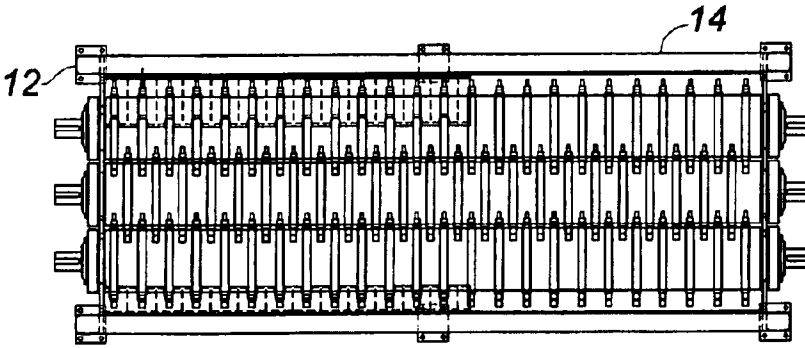
FIG. 5 is a top plan view of one embodiment.
Figure 6:
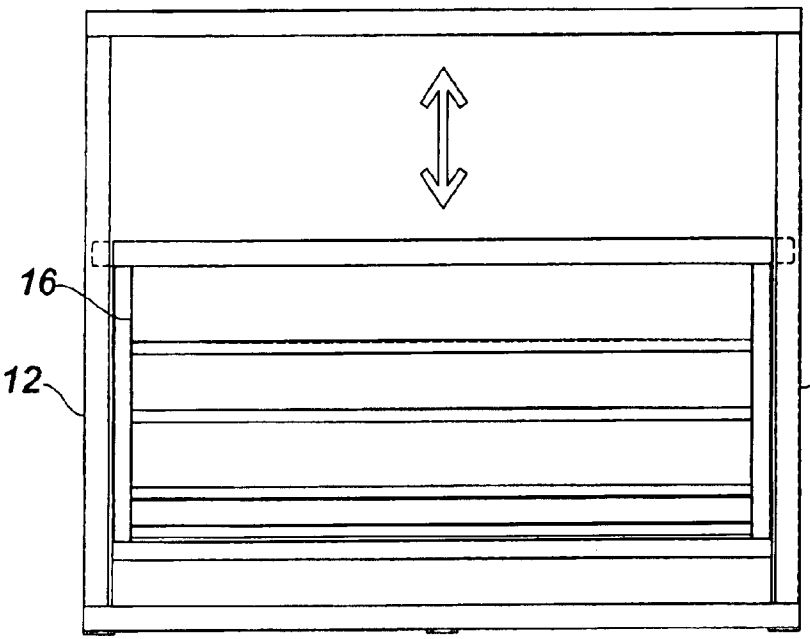
FIG. 6 is a front elevation view of one embodiment.
Figure 7:
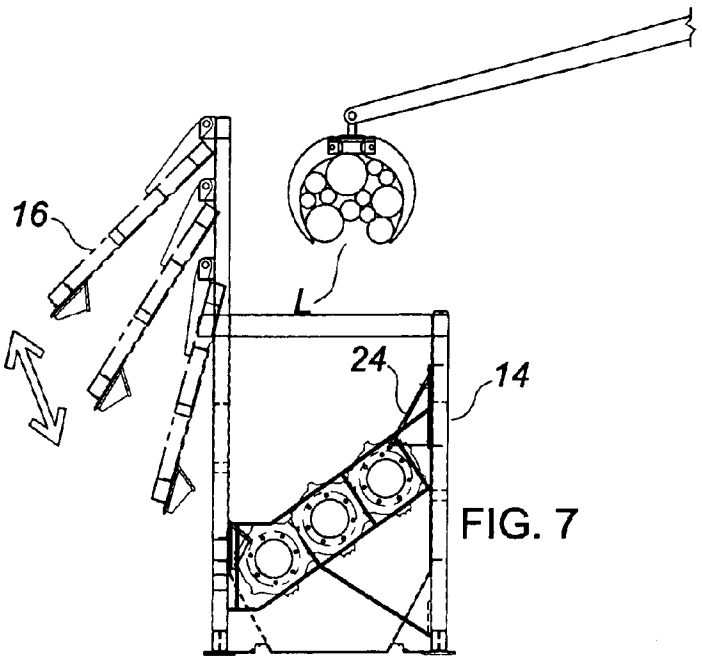
FIG. 7 is a vertical cross-section view of one embodiment.
Figure 8:
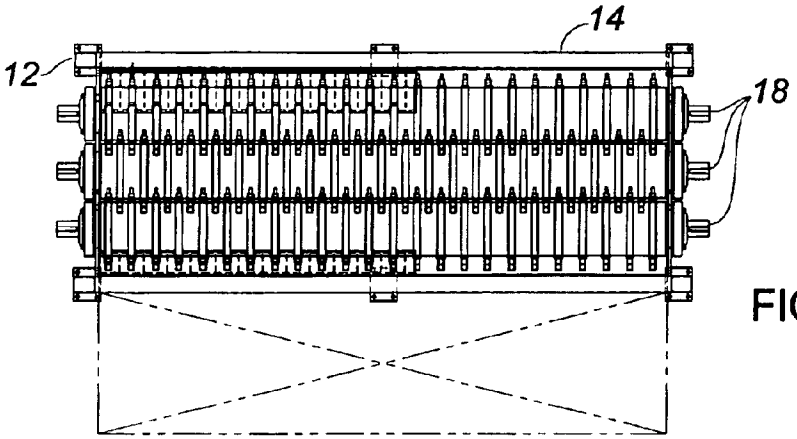
FIG. 8 is a top plan view of one embodiment.
Figure 9:
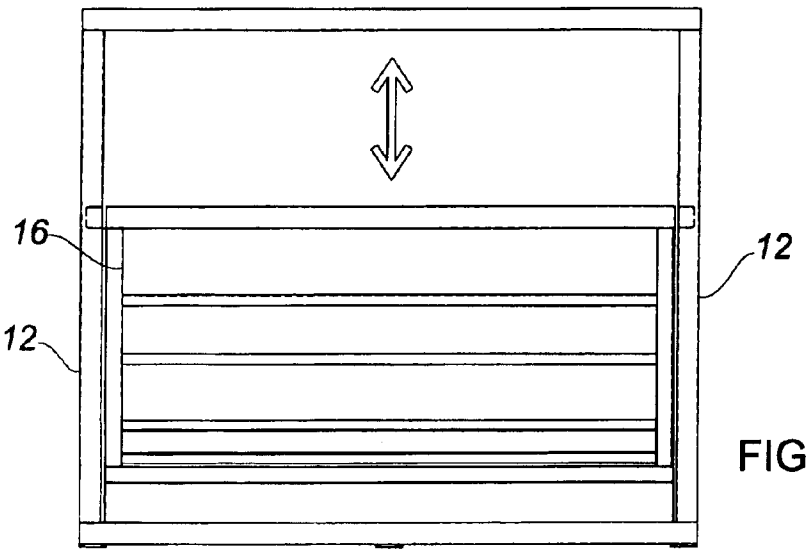
FIG. 9 is a front elevation view of one embodiment.

In an alternative embodiment illustrated in FIGS. 4, 5 and 6, the discharge. sidewall is adapted to slide vertically between open and closed positions. In a further alternative embodiment shown in FIGS. 7, 8 and 9, the discharge sidewall both slides vertically and is hinged along its top edge.

Figure 10:
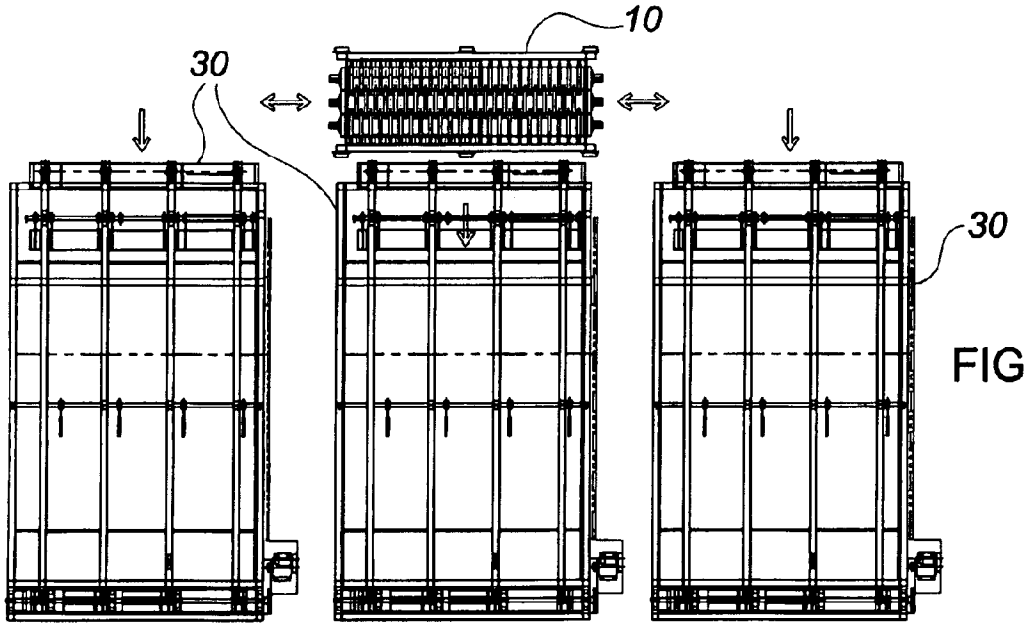
FIG. 10 is a top plan view of one embodiment where one debarker may feed three strander feed decks.
Figure 11:
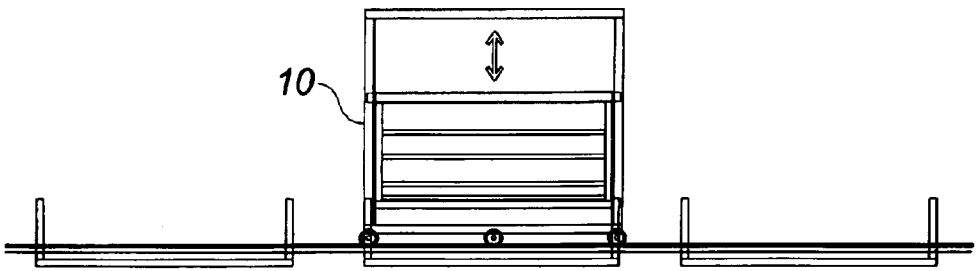
FIG. 11 is a front elevation view of FIG. 10.
Figure 12:
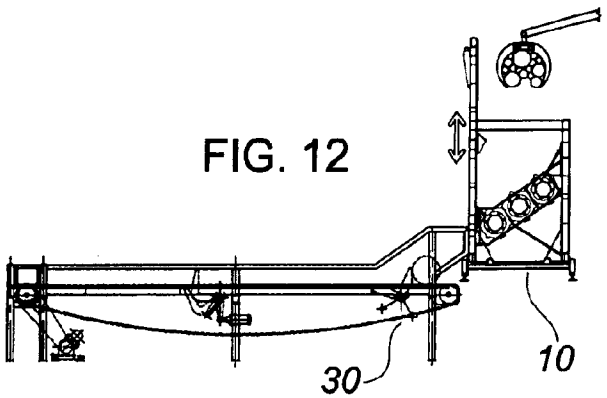
FIG. 12 is a side view of FIG. 10.

As shown in FIGS. 10, 11 and 12, the debarker may discharge logs laterally directly to a strander feed deck (30). In one embodiment, the debarker may be mounted to rails or the like to feed a plurality of strander feed decks (30) installed side by side.

Figure 15:
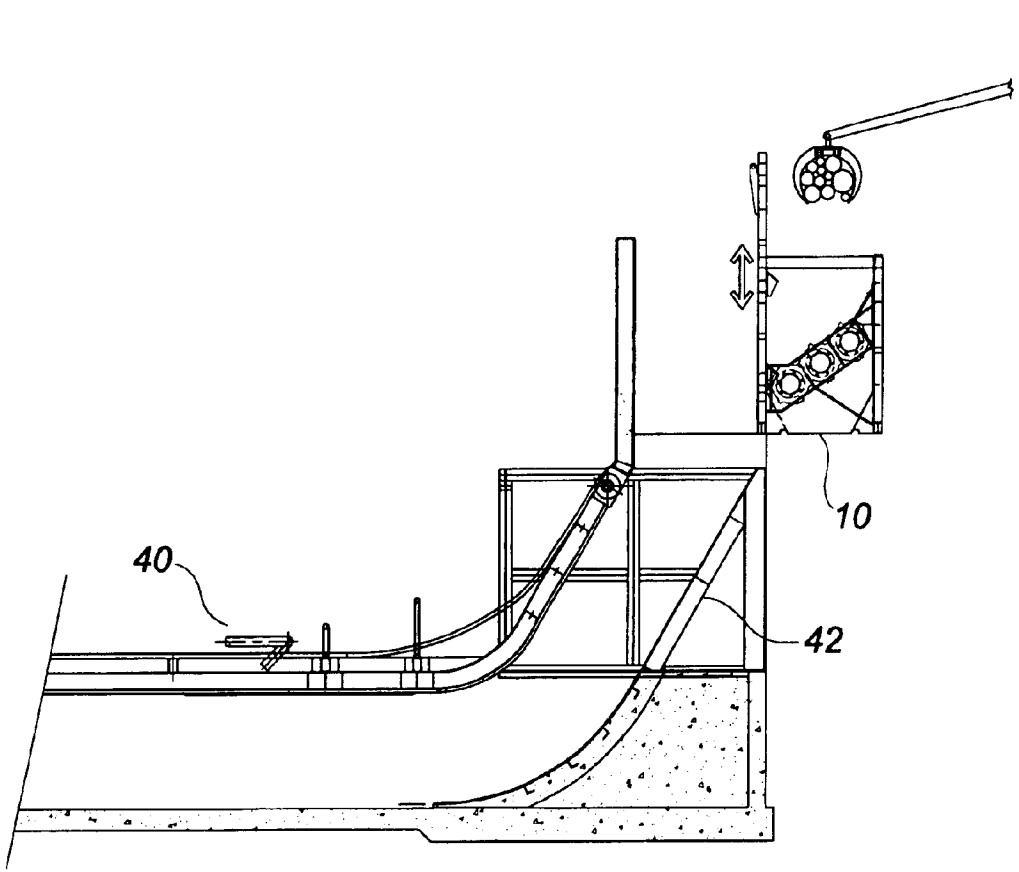
FIG. 15 is a side view of FIG. 13.
Figure 13:
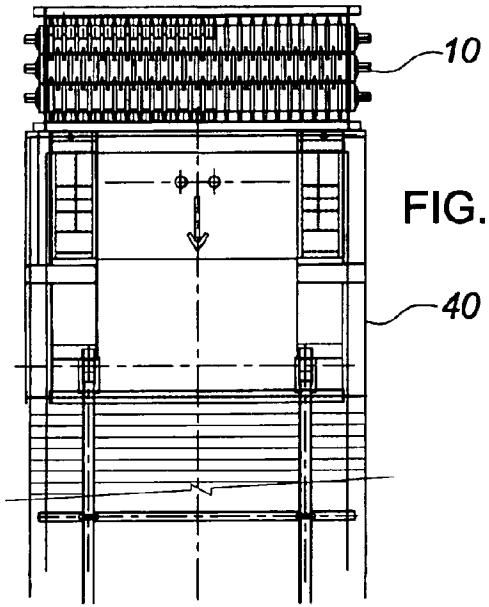
FIG. 13 is a top plan view of one embodiment.
Figure 14:
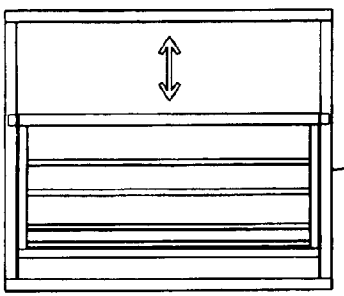
FIG. 14 is a front elevation view of FIG. 13.

In another embodiment shown in FIGS. 13, 14 and 15, the debarker may be disposed immediately above a log pond (40) so that the logs may be laterally discharged directly into the log pond or down a chute (42) into the log pond.

Figure 16:
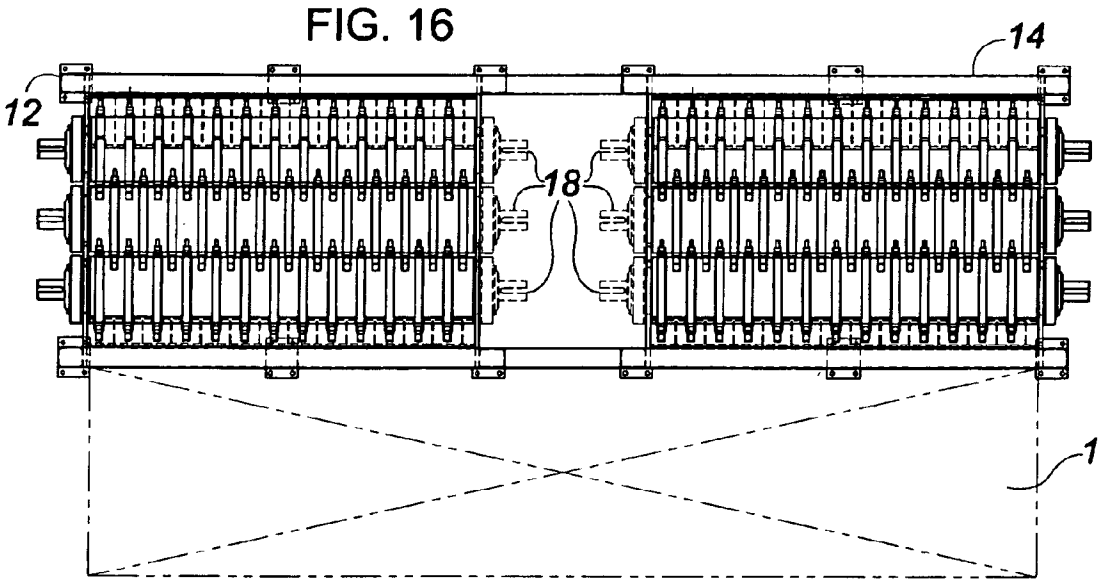
FIG. 16 is a top plan view of one embodiment.
Figure 17:
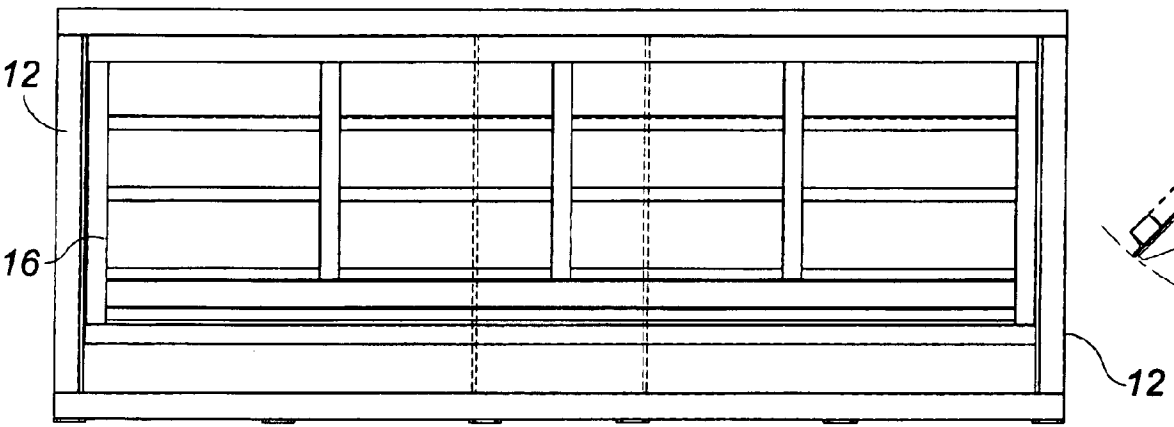
FIG. 17 is a front elevation view of FIG. 16.
Figure 18:
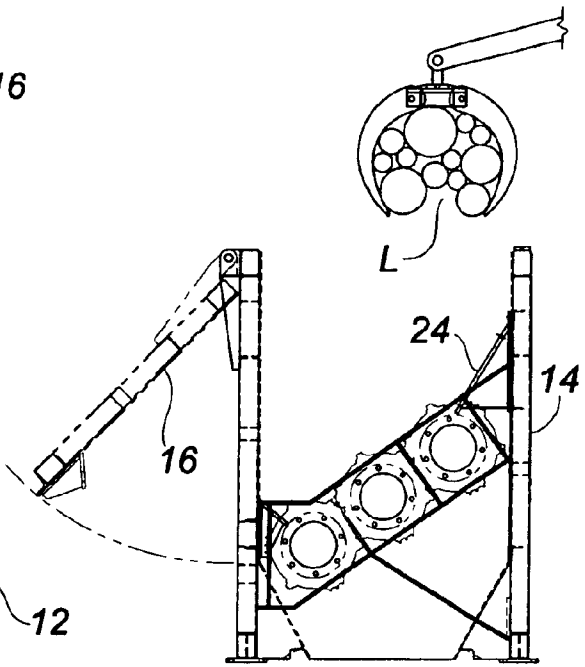
FIG. 18 is a side view of FIG. 16.

In another embodiment, the bin (10) may enclose two sets of rotors (18) as may be seen in FIGS. 16, 17 and 18. Such a double length bin may be particularly suitable for debarking very long logs.

Figure 19:
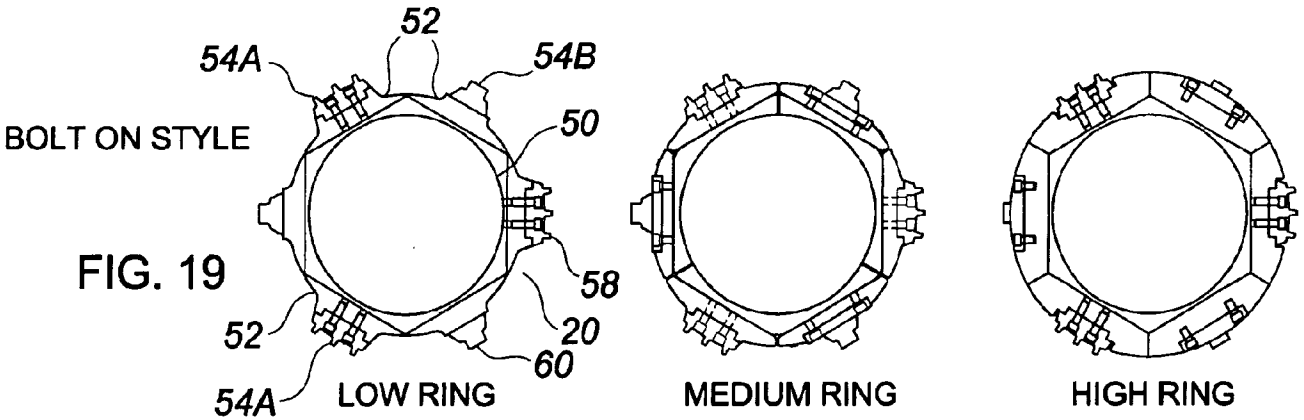
FIG. 19 is a vertical cross-section of a bolt-on style abrader assembly.
Figure 20:
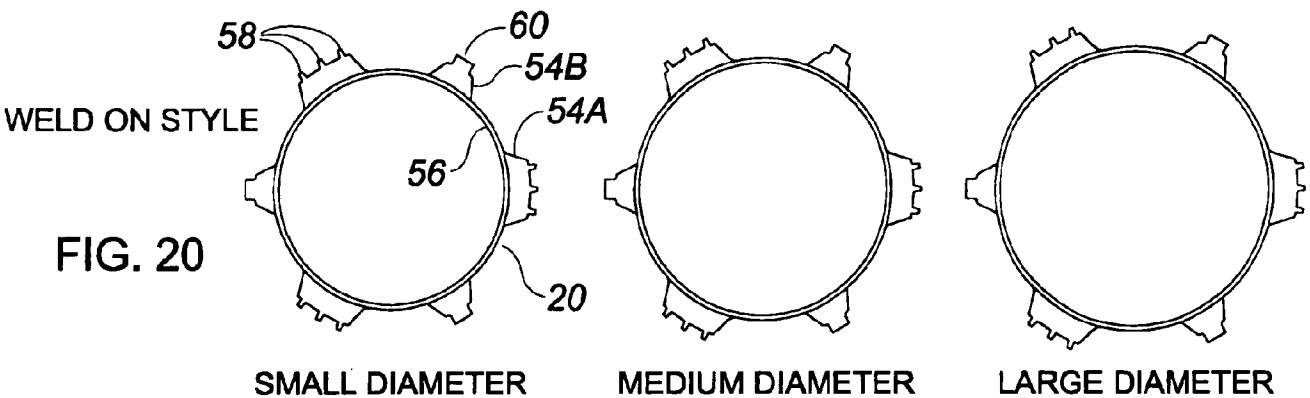
FIG. 20 is a vertical cross-section of a weld-on style abrader assembly.

One embodiment of the abrader assemblies (20) is illustrated in FIG. 19 and an alternative embodiment is shown in FIG. 20. In either example, the abrader assemblies are affixed to a parent ring (not shown) which encircles the rotor (18). In FIG. 19, a support ring (50) having a hexagonal profile is welded to the parent ring and abrader blocks (52) are then welded to the flat outer surfaces of the support ring (50). The replaceable abrader tips (54) are then bolted into the abrader blocks (52) as shown. In FIG. 20, a circular support ring (56) comprises a few sections which are welded to parent ring. The abrader tips (54) are then welded directly to the support ring (56). In either case, two types of abrader tips (54) are provided and are alternated about the periphery of the abrader assembly. A primary abrader tip (54A) may typically have three teeth (58) while a secondary abrader tip (54B) has typically a single tooth (60). The number of teeth on each of the primary and secondary abrader tips may be varied depending on debarking conditions required or desired.

Figure 22:
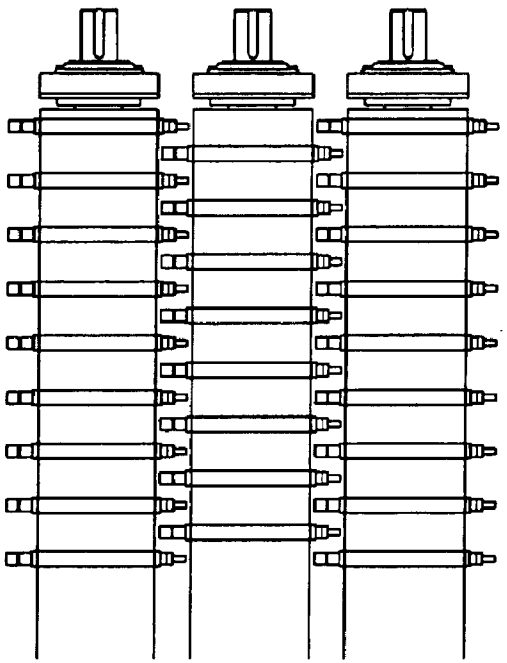
Figure 21:
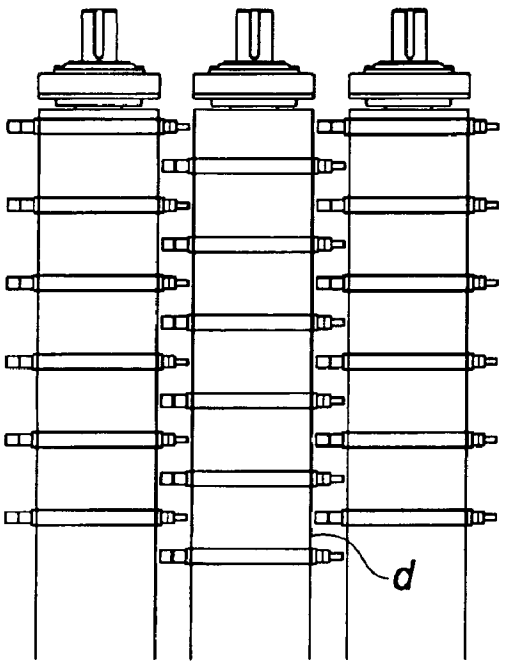

The longitudinal spacing between abraders (20) along a shaft determines the amount of void space in the live floor created by the rotors (18) and abraders (20). In FIG. 21, a relatively wide spacing of d=4.5 inches is shown. In FIG. 22, a moderate spacing of d=2.5 inches is shown while in FIG. 23 a tight spacing of d=0.5 inches is shown. The design of this particular variable, and others disclosed herein, in the design of specific debarker in accordance with present invention may be varied for particular conditions and species of wood to be processed with minimal experimentation and trial and error.

Figure 23:
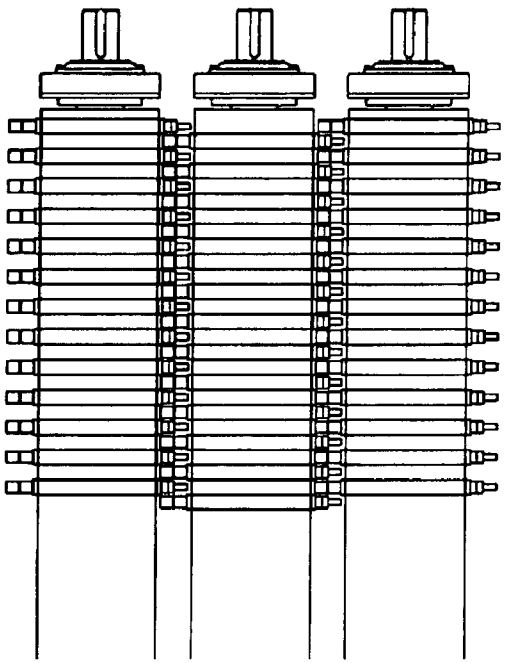
FIGS. 21, 22 and 23 are top plan views of adjacent showing differing abrader assembly spacing.
Figures 24, 25, 26:
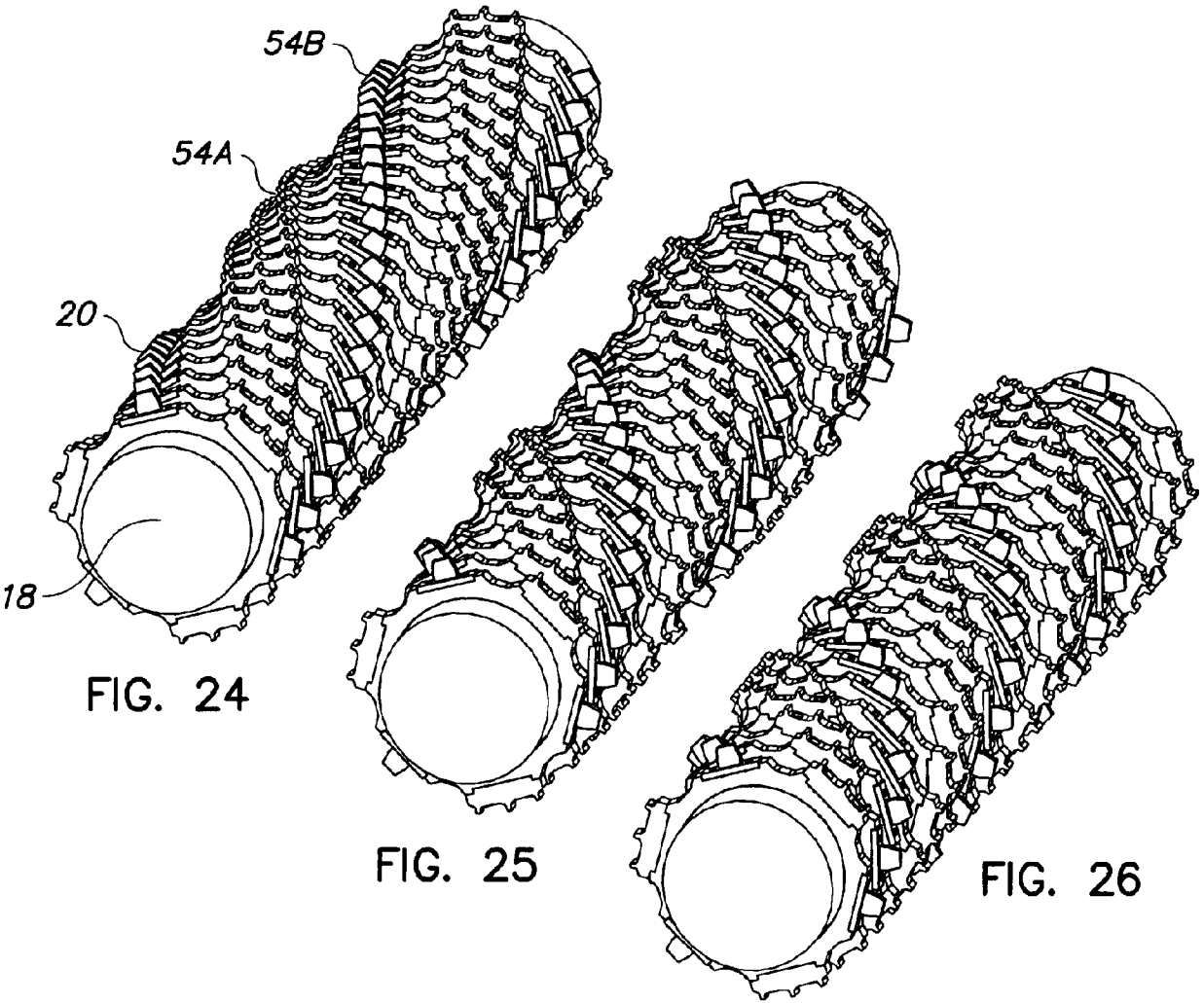
FIGS. 24, 25 and 26 are perspective views of helical arrangements of the abrader assemblies.

The abrader tips (54) may be aligned along a rotor such that primary abrader tips and secondary abrader tips are aligned longitudinally, parallel to the rotor axis. Alternatively, the primary and secondary abrader tips may be alternated along such a longitudinal axis. In another alternative embodiment, the abrader assemblies are arranged such that the primary and/or secondary abrader tips are aligned helically about the rotor axis as shown in FIG. 23. Tighter helical arrangements are shown in FIGS. 24 and 25. The helical arrangement may follow a right-hand or left-hand helix and both left and right helices may be used in a debarker. In one embodiment shown in FIG. 26, having five rotors, the lower two rotors have left-hand helices while the upper two rotors have right-hand helices. The middle rotor may be either left-hand or right-hand. Alternatively, right and left-hand helices may be alternated from rotor to rotor. As may be appreciated by one skilled in the art, the use of helically arranged abrader tips may promote some limited longitudinal movement of the logs within the bin, enhancing the debarking process.

Figure 27:
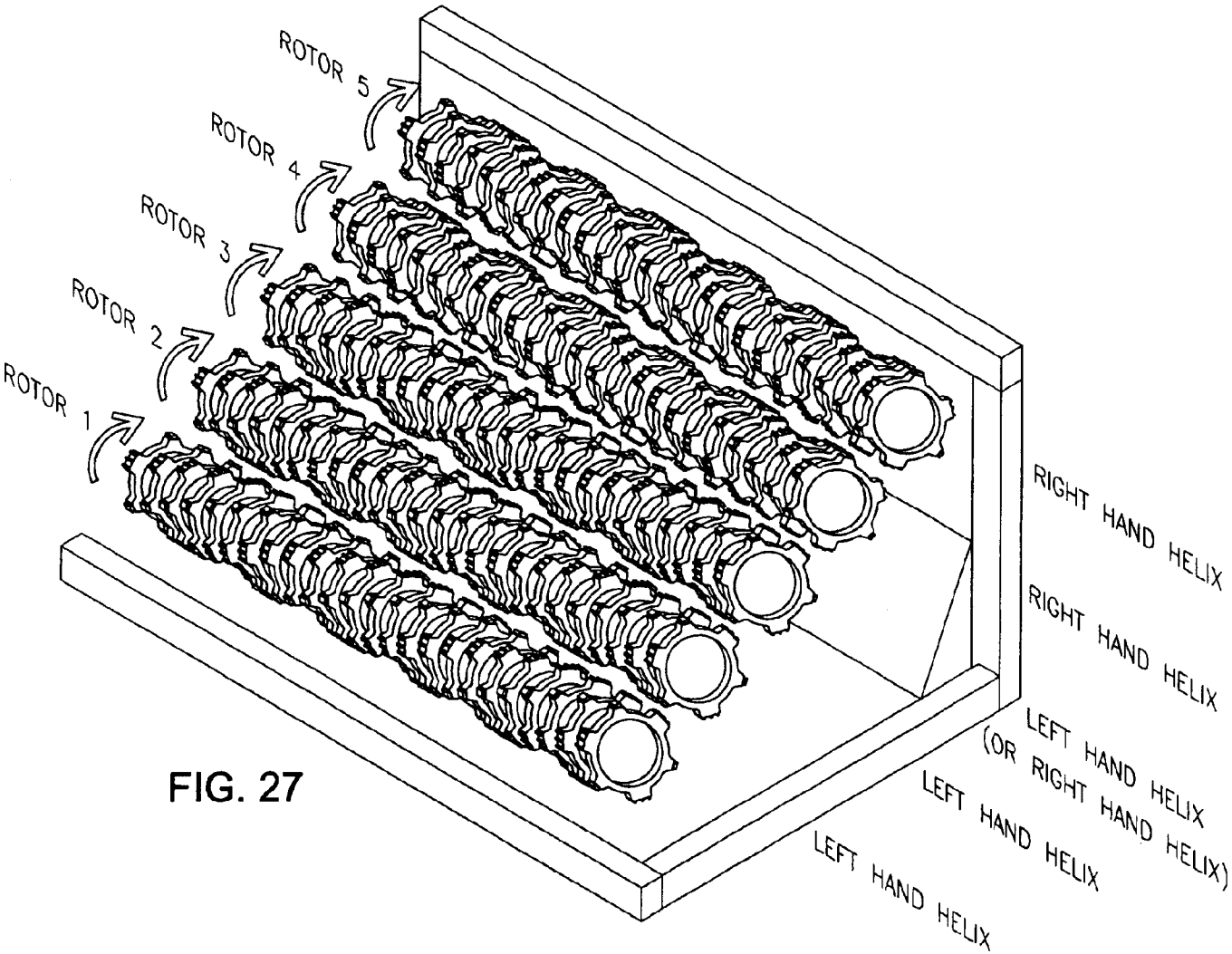
FIG. 27 is a schematic view of a multiple shaft arrangement of differing helical arrangements of abrader assemblies.
Figure 30:
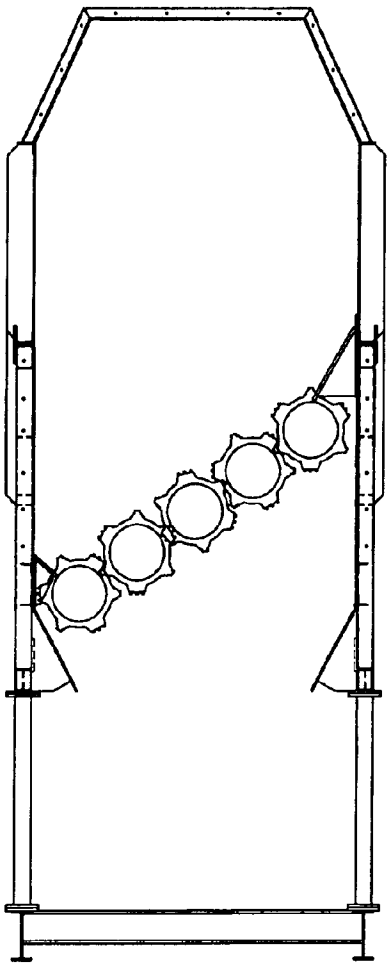
FIGS. 28, 29 and 30 are side views of different embodiments utilizing 3, 4 or 5.
Figure 29:
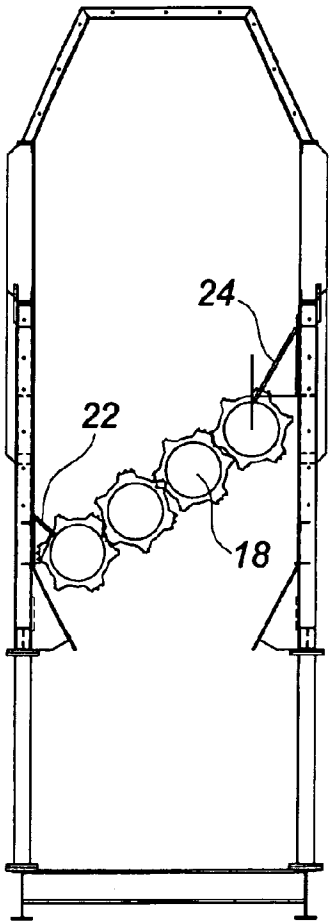
Figure 28:
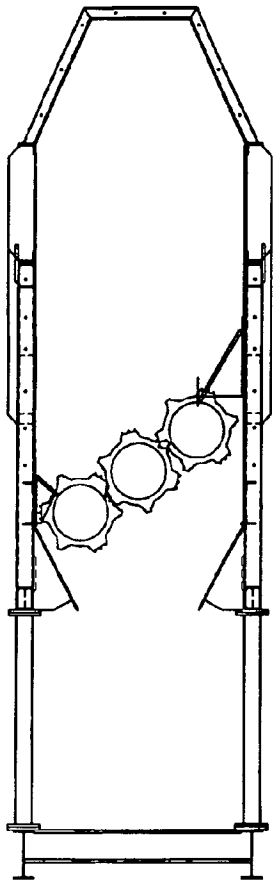
Figure 31:
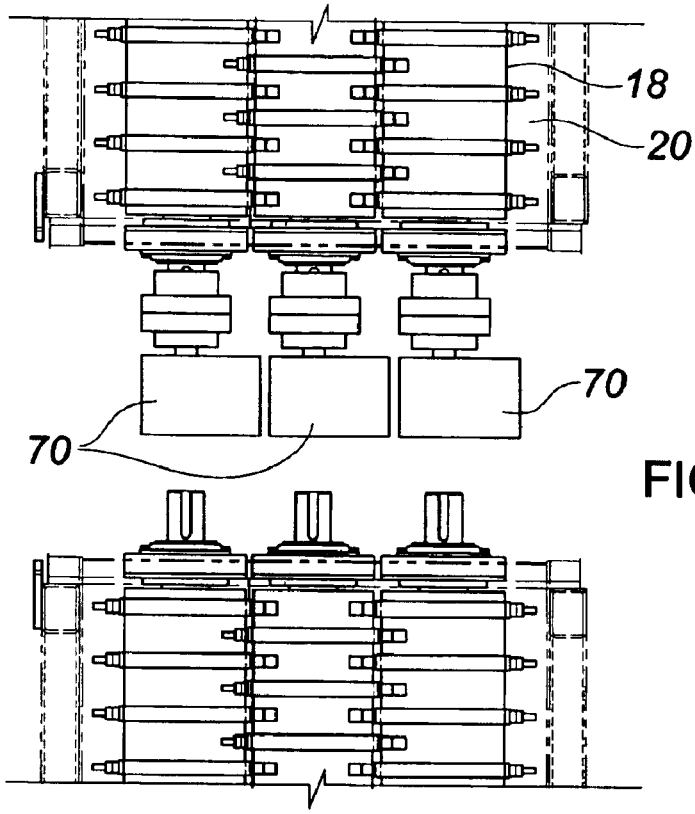
FIG. 31 is a top view of powered by individual power sources.

The invention is not intended to be limited by the number of rotors (18) disposed within the bin (10). In alternative embodiments, three, four or five rotor models may be provided as shown in FIGS. 27, 28 and 29. Conceivably, the invention could be operated with as few as two rotors and with as many rotors as can practically be fit within a bin. In a preferred embodiment, each rotor is individually driven by an independent power source (70) which may be a variable speed electric motor, hydrostatic drive or any other suitable power source. In this manner, the direction and speed of rotation of each rotor may be individually controlled and varied to achieve desired results. The power sources are illustrated in FIGS. 30 and 31.

Figure 32:
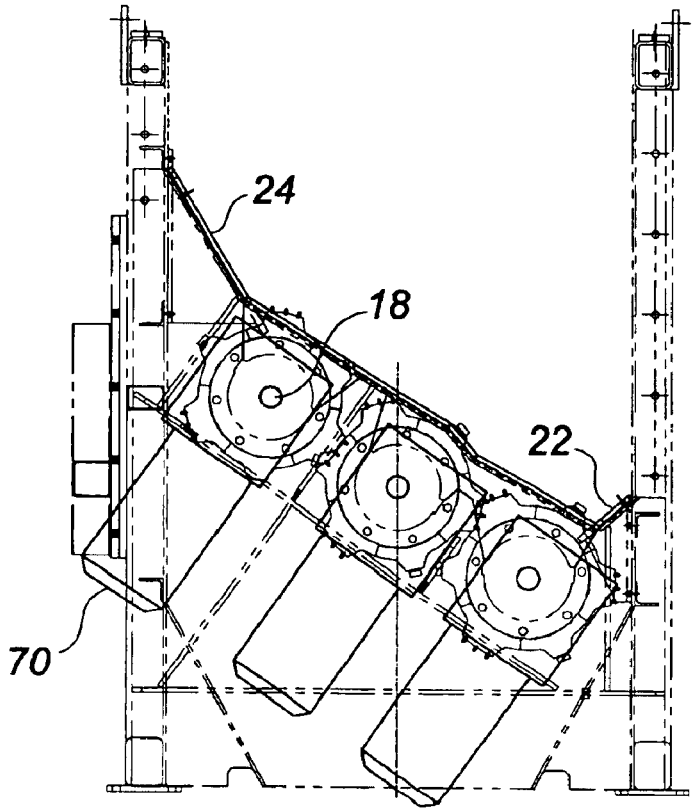
FIG. 32 is a side view of FIG. 31.
Figure 33:
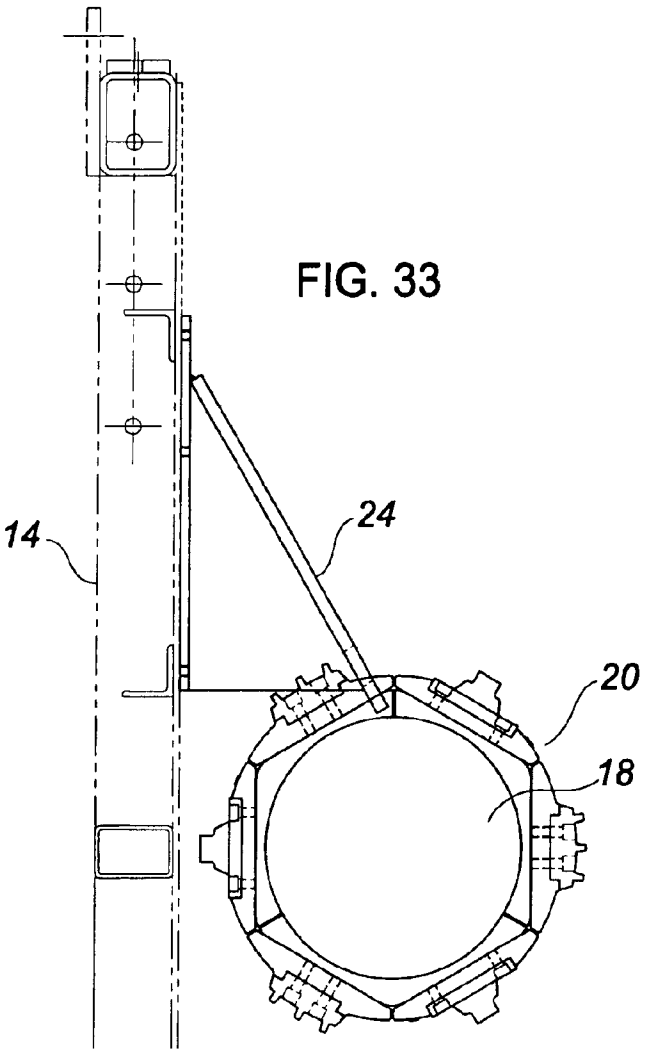
FIG. 33 is a side view of a upper finger bar.
Figure 35:
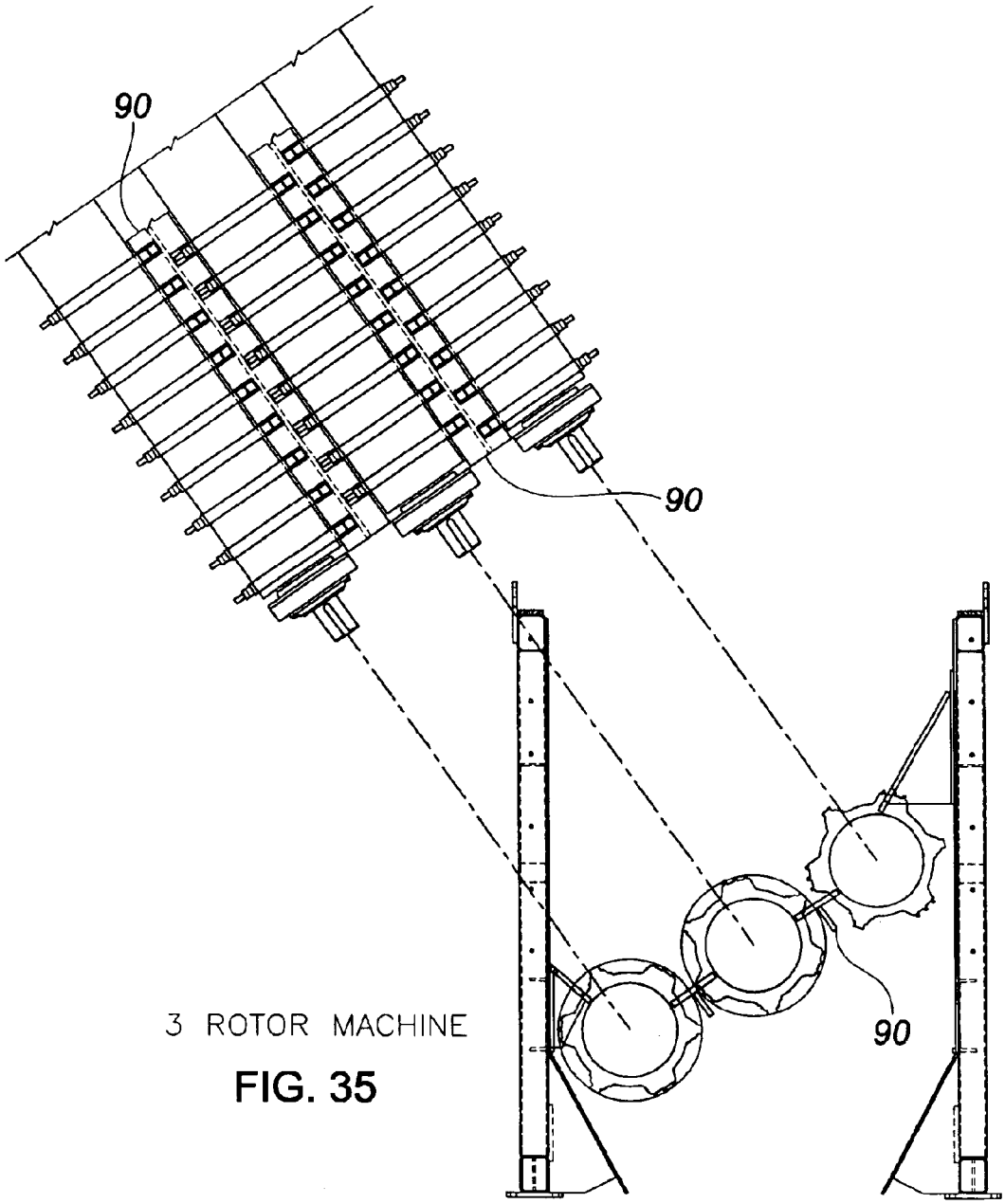
FIG. 35 is a side view of an alternative embodiment using inter-shaft finger plates.

The upper fingerplate shown in FIG. 32 ensures that logs which roll up against the closed sidewall (14) do not jam between the uppermost rotor (18) and the sidewall (14). In an alternative embodiment shown in FIG. 33, supplementary rotating elements (80) are provided behind the fingerplate (24) to allow logs to more easily slide upwards or downwards along the fingerplate. Alternatively, the supplementary rotating elements (80) may be actively rotated using a power source to encourage upward movement of the logs.

Figure 34:
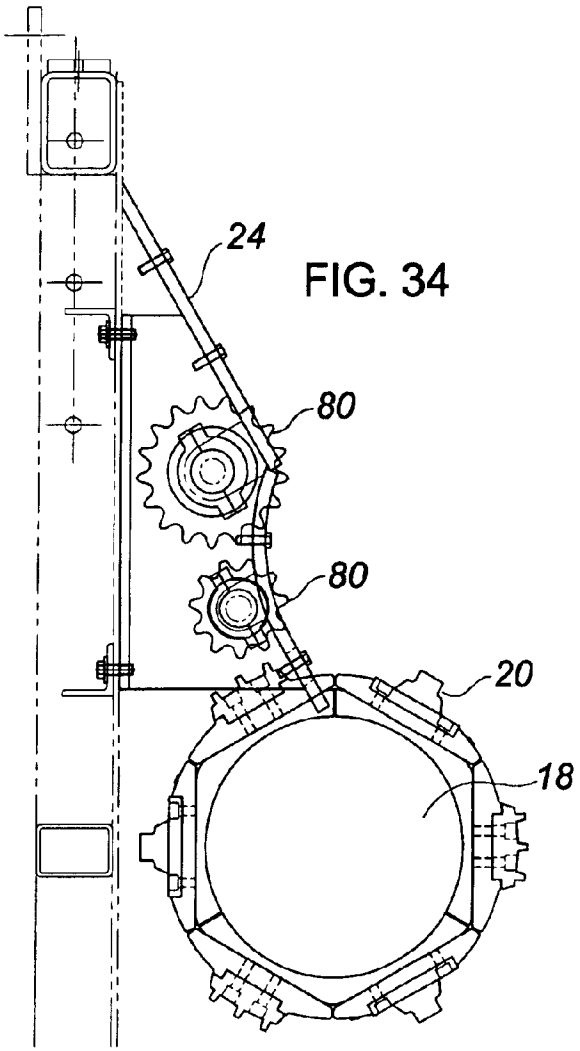
FIG. 34 is a side view of an alternative live upper finger bar.

In an alternative embodiment, the invention may also comprise inter-rotor finger plates (90) as shown in FIG. 34. These finger plates (90) fit between adjacent rotors (18) and the abrader assemblies (20). The finger plates (90) have the effect of providing a closed floor apparatus which will tend to retain smaller pieces of wood fibre which would otherwise be rejected through the bottom of the debarker.

In a preferred embodiment, the apparatus may be controlled by a computer system which controls operating variables in accordance with user settings. The operating variables may include dwell time of logs within the apparatus, speed of rotation of the rotors and direction of rotation of the rotors. In one embodiment, the system may be programmed to initiate a debarking batch by rotating all of the rotors in the same direction with a relatively fast speed. The speed and direction of rotation may then be varied within a single dwell cycle to achieve efficient debarking. The control system may also control the opening or displacement of the discharge sidewall to discharge the logs after a debarking process.

As will be apparent to those skilled in the art, various modifications, adaptations and variations of the foregoing specific disclosure can be made without departing from the scope of the invention claimed herein. Various features of the invention described herein may be combined in different combinations that those specifically disclosed herein.

What is claimed is:

1. A debarking apparatus comprising:

(a) a rectangular bin having two endwalls and two elongate sidewalls;

(b) a plurality of substantially parallel abrader rotors placed across the bin;

(c) a plurality of abrader blocks attached to the abrader rotors in a longitudinally spaced manner; and (d) wherein one sidewall or a portion of one sidewall may be displaced to release logs held within the bin; and (e) means for rotating each rotor independently of the other rotors, such that the rotors may be rotated at different speeds in the same direction, at the same speed in different directions, at different speeds in different directions, or at the same speed in the same direction.

2. The debarking apparatus of claim 1 wherein the abrader blocks of one abrader rotor interleave with the abrader blocks of an adjacent abrader rotor.

3. The debarking apparatus of claim 1 wherein the plurality of abrader rotors and abrader blocks creates a live floor.

4. The debarking apparatus of claim 1 further comprising stationary finger plates disposed between the abrader rotors and abrader blocks.

5. The debarking apparatus of claim 1 comprising at least three abrader rotors.

6. The debarking apparatus of claim 1 wherein each abrader block comprises a replaceable abrader tips, which may be welded or bolted to the blocks.

7. The debarking apparatus of claim 1 wherein the abrader blocks of a rotor are arranged in a helical pattern about a central longitudinal axis of the rotor.

8. A debarking apparatus comprising:

(a) a rectangular bin having two endwalls and two elongate sidewalls;

(b) a plurality of substantially parallel abrader rotors placed across the bin;

(c) a plurality of abrader blocks attached to the abrader rotors in a longitudinally spaced manner; and (d) wherein one sidewall or a portion of one sidewall may be displaced vertically to release logs held within the bin; and (e) means for sliding the displaceable sidewall vertically.

9. The debarking apparatus of claim 8 wherein the sidewall or portion of the sidewall may be pivoted outward, and further comprising means for pivoting the sidewall outwards.

10. The debarking apparatus of claim 1 further comprising a control system for controlling a debarking process, including dwell time and speed and direction of shaft rotation.

11. A method of debarking logs comprising the steps of:

(a) providing a debarking apparatus including a rectangular bin having two endwalls and two elongate sidewalls; a plurality of abrader rotors placed across a lower section of the bin parallel with the sidewalls; a plurality of abrader blocks attached to the abrader rotors, one sidewall or a portion of one sidewall may be displaced to release lo gs held within the bin; and wherein each rotor may be independently rotated at different speeds and in different directions;

(b) introducing a batch of logs into the apparatus and controlling direction and speed of rotation of the rotors until the logs are substantially debarked;

(c) displacing the sidewall to discharge the logs laterally.

12. The debarking apparatus of claim 8 further comprising means for rotating each rotor independently of the other rotors, such that the rotors may be rotated at different speeds in the same direction, at the same speed in different directions, at different speeds in different directions, or at the same speed in the same direction.

13. The debarking apparatus of claim 12 further comprising a control system for controlling a debarking process, including dwell time and speed and direction of shaft rotation.

* * * * *